US011247315B2

(12) United States Patent
MacDonald

(10) Patent No.: US 11,247,315 B2
(45) Date of Patent: Feb. 15, 2022

(54) IMPACT WRENCHES, WRENCH SYSTEMS, AND METHODS OF USE

(71) Applicant: Jeffrey Dean MacDonald, Victoria (CA)

(72) Inventor: Jeffrey Dean MacDonald, Victoria (CA)

( * ) Notice: Subject to any disclaimer, the term of this patent is extended or adjusted under 35 U.S.C. 154(b) by 339 days.

(21) Appl. No.: 16/443,751

(22) Filed: Jun. 17, 2019

(65) Prior Publication Data

US 2019/0381637 A1 Dec. 19, 2019

Related U.S. Application Data

(60) Provisional application No. 62/686,087, filed on Jun. 17, 2018.

(51) Int. Cl.

| | |
|---|---|
| ***B25B 19/00*** | (2006.01) |
| ***B25D 1/16*** | (2006.01) |
| ***B25B 23/16*** | (2006.01) |
| ***B25B 23/00*** | (2006.01) |

(52) U.S. Cl.

CPC ..... *B25B 19/00* (2013.01); *B25B 23/0035* (2013.01); *B25B 23/16* (2013.01); *B25D 1/16* (2013.01)

(58) Field of Classification Search

CPC ..... B25D 1/16; B25B 23/16; B25B 23/0035; B25B 19/00

See application file for complete search history.

(56) References Cited

U.S. PATENT DOCUMENTS

| | | | | |
|---|---|---|---|---|
| 1,850,239 | A * | 3/1932 | McCarthy | B25B 19/00 173/93 |
| 6,085,621 | A * | 7/2000 | Nezigane | B25B 19/00 81/465 |
| 10,065,454 | B2 * | 9/2018 | Coetzee | B60B 29/005 |
| 10,661,415 | B1 * | 5/2020 | Roche | B25B 21/02 |
| 2011/0088520 | A1 * | 4/2011 | Albrecht | B25B 19/00 81/124.7 |

* cited by examiner

*Primary Examiner* — David B. Thomas

(74) *Attorney, Agent, or Firm* — Law Office Of Michael Antone; Michael Antone

(57) ABSTRACT

Impact wrenches of the present invention generally include a handle including a slide hammer that is movable relative to a head end of the wrenches. The head includes a force translation portion positioned to translate force applied to the force translation portion from the slide hammer to rotate a tool connected to the force translation portion. When the tool is engaged with a rotatable fitting a substantially linear force applied with the slide hammer may be translated to the tool, which converts at least a portion of the force to a rotational force to loosen or tighten the fitting.

20 Claims, 4 Drawing Sheets

IMPACT WRENCHES, WRENCH SYSTEMS, AND METHODS OF USE

CROSS-REFERENCE TO RELATED APPLICATIONS

This non-provisional patent application claims the benefit of and priority to U.S. Provisional Patent Application No. 62/686,087 filed Jun. 17, 2006, which is incorporated herein by reference in its entirety.

BACKGROUND OF THE INVENTION

Field of the Invention

The present disclosure relates to wrenches. More particularly the present disclosure relates to impact wrenches that enable the increased application of force to fittings, particularly in areas with reduced access to the fitting.

Background Art

Many different types and sizes of wrenches and other tools have been developed over the years to facilitate the tightening and loosening of rotatable fittings (i.e., nuts, bolts, screws, etc.). In some instances, the fittings may end up overly tight, so the fitting is not easily loosened using traditional tools and not accessible or easily loosened by power tools. In other instances, it may be desirable to tighten a fitting beyond a point that is easily achieved using tools that can be used to access the fitting. If the fitting can not be loosened, then it may be necessary to cut off the fitting. If a fitting that can not be sufficiently tightened, then there is an increased risk the fitting may not perform its function properly in operation. Given the potential damage that can result from attempting to cut off a fitting or not fully tightening a fitting, there is a continuing need for tools that allow a user to apply increased levels of force to the loosening and tightening of fittings.

BRIEF SUMMARY OF THE INVENTION

Accordingly, the present invention provides impact wrenches that allow a user to apply increased levels of force to rotational fittings by enabling the user to application linear force to the wrench that is converted by the wrench to a rotational force to loosen or tighten fittings.

The impact wrench generally includes a handle including a slide hammer and an integrated or separate grip. The handle is movable relative to a head end of the wrench and used to apply a linear impact force to the head. The head includes a force translation portion positioned to translate force applied to the force translation portion from the slide hammer to rotate a tool connected to the force translation portion. When the tool is engaged with a rotatable fitting, the linear force applied with the slide hammer is translated to the tool via the force translation portion, which converts and imparts at least a portion of the linear force to the fitting as a rotational force for the purpose of loosening or tightening the fitting engaged by the tool.

A guide may be used in combination with the slide hammer and the force translation portion to support a consistent application of force from the slide hammer to the tool via the force translation portion of the head. The shape and other features of the guide may be varied to accommodate various use cases and design objectives. The guide may be integrated with either or both the handle and the head, removably or fixedly connected to the handle or the head of the wrench, or may be connected to one of the handle or head and brought into contact with the other of the handle or head in operation.

The tool may be permanent, semi-permanently, or interchangeably attached to a tool attachment portion of the force translation portion. The tools may include one or more of ratcheting and non-ratcheting open-end fixed, open-end adjustable, flare nut, 6-point box-end, 12-point box-end, spline, conventional socket adapter, and pass-thru socket wrenches. The tool attachment portion may include a bracket to which the tool is removably connected. In some embodiments more than one tool may be attached to the force translation portion at one time. However, in most applications, only one tool will be used at a time to engage a fitting and the other tools connected to the tool attachment portion will dangle freely and not be engaged with the fitting.

In operation, the impact wrench may be employed to loosen or tighten various fittings by attaching a tool to a force translation portion of an impact wrench and engaging a fitting rotatable in a plane with the tool. The slide hammer is extended from an impact position in contact with the force translation portion. Force is then applied to the slide hammer to drive the hammer into contact with the force translation portion at the impact position, which translates the force to rotate the tool and the fitting engaged by the tool.

As may be disclosed, taught, and/or suggested herein to the skilled artisan, the present invention addresses the continuing need for wrenches with improved performance and utility.

BRIEF DESCRIPTION OF THE DRAWINGS

The accompanying drawings are included for the purpose of exemplary illustration of various aspects of the present invention to aid in description, and not for purposes of limiting the invention, wherein.

Figure 1:
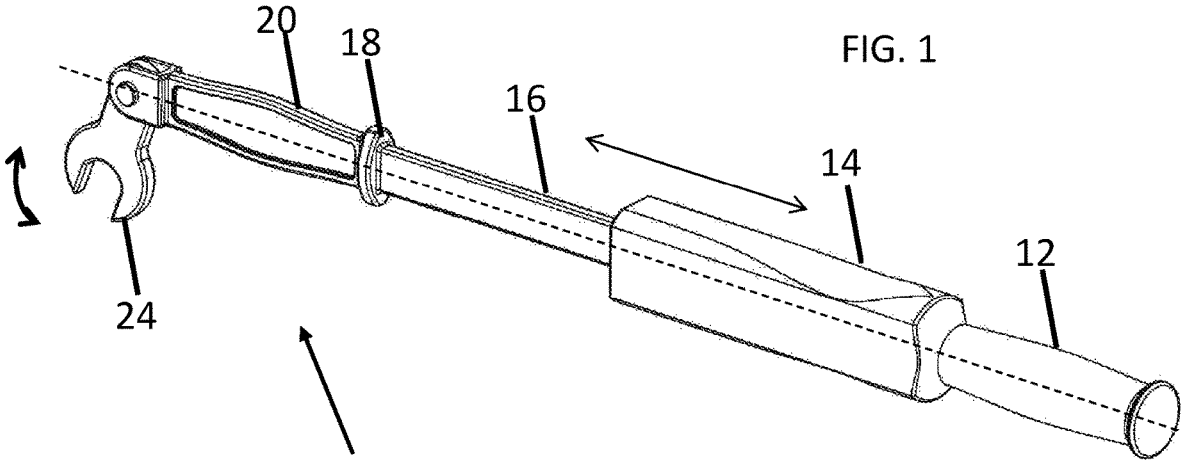
FIGS. 1-7 illustrate various perspective views of assembled and disassembled embodiments.

In the drawings and detailed description, the same or similar reference numbers may identify the same or similar elements. It will be appreciated that the implementations, features, etc. described with respect to embodiments in specific figures may be implemented with respect to other embodiments in other figures, unless expressly stated, or otherwise not possible.

No claim is made to any images, names, or any other intellectual property of others that may be depicted in the specification and drawings, and all intellectual property rights owned by others remain with the property of those others. Any use of others' intellectual property herein is meant to be only exemplary in nature to aid in describing the invention and not meant to suggest or claim any ownership in, or right to, their intellectual property.

DETAILED DESCRIPTION OF THE INVENTION

Figure 2:
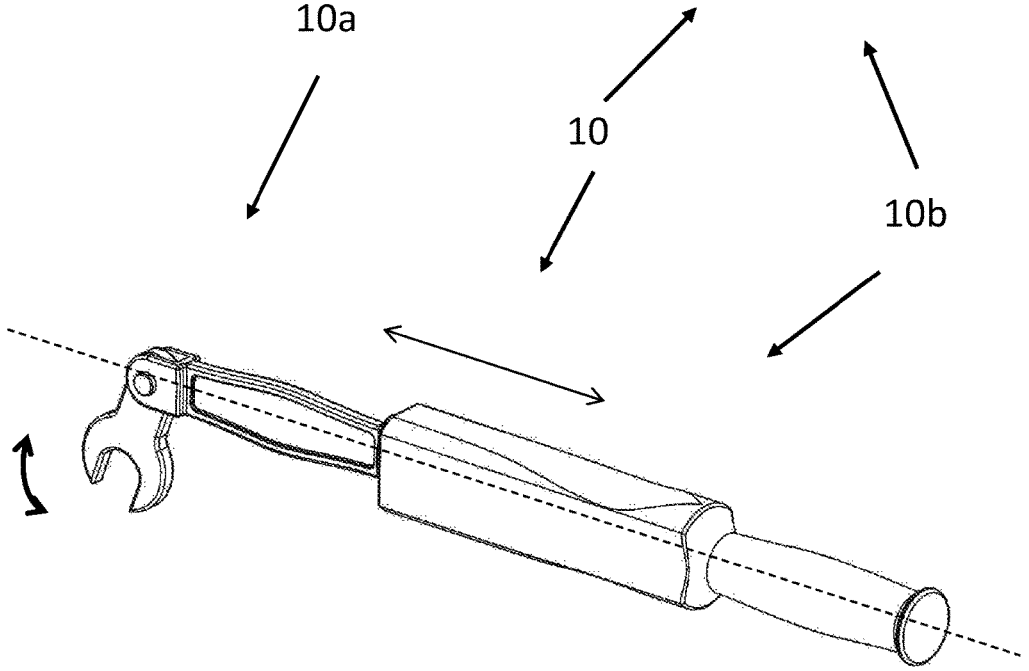

Impact wrenches, wrench systems, and methods of the present invention are described herein, by way of example and otherwise. FIGS. 1 and 2 illustrate various exemplary impact wrenches or wrench systems 10 including a head or head end/portion 10*a*, and a handle or handle end/portion 10*b*. The head 10*a* and handle 10*b* may also be referred to as the fixed and moving portions, respectively, as the handle 10*b* will generally be moved relative to the head 10*a* in operation of the wrench 10.

FIGS. 1 and 2 show various embodiments with the handle 10*b* in different positions relative to the head end 10*a*. FIG. 1 shows the handle 10*b* in an extended position relative to the head 10*a*. FIG. 2 shows the handle 10*b* in an impact position relative to the head 10*a*.

The wrench 10 may be sized and shaped by the skilled artisan to achieve a desired level of impact. It will be further appreciated that the wrench system 10 may include various head ends 10*a* that may be interchanged with various handles 10*b* depending upon the particular application.

Figure 3:
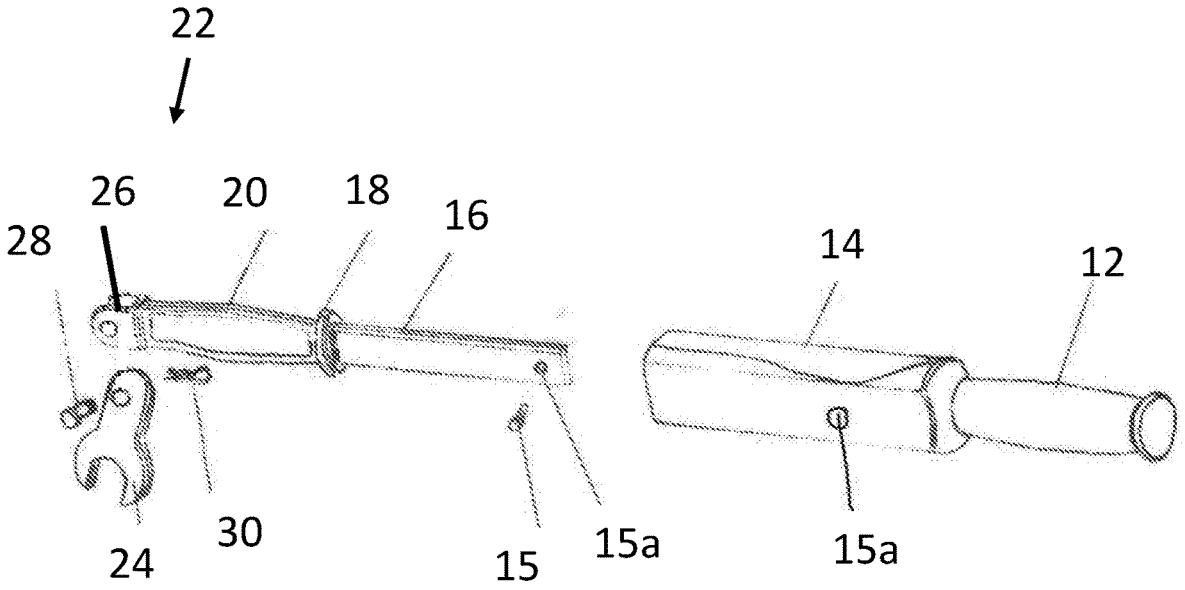
Figures 4, 5:
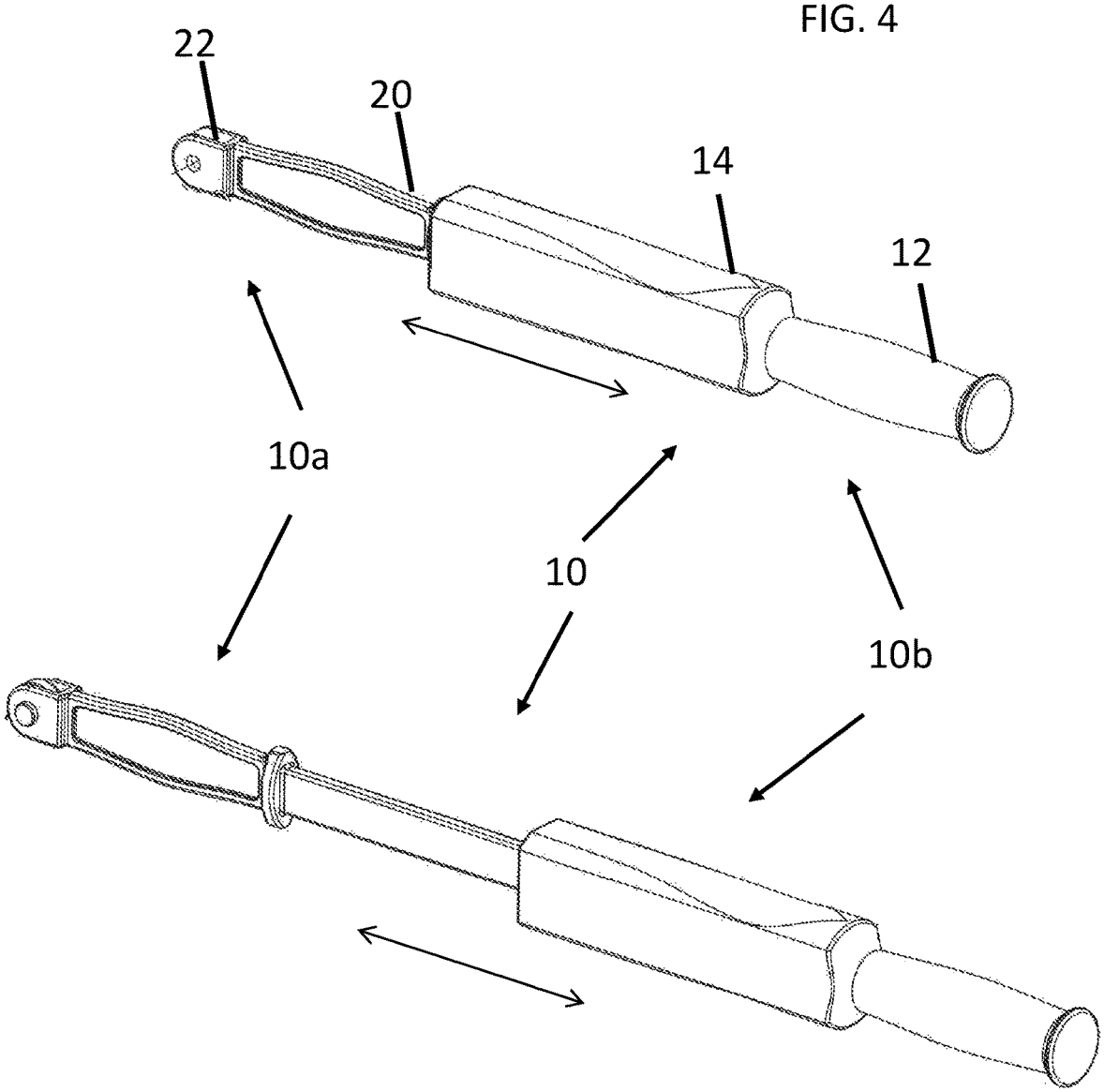
Figure 6:
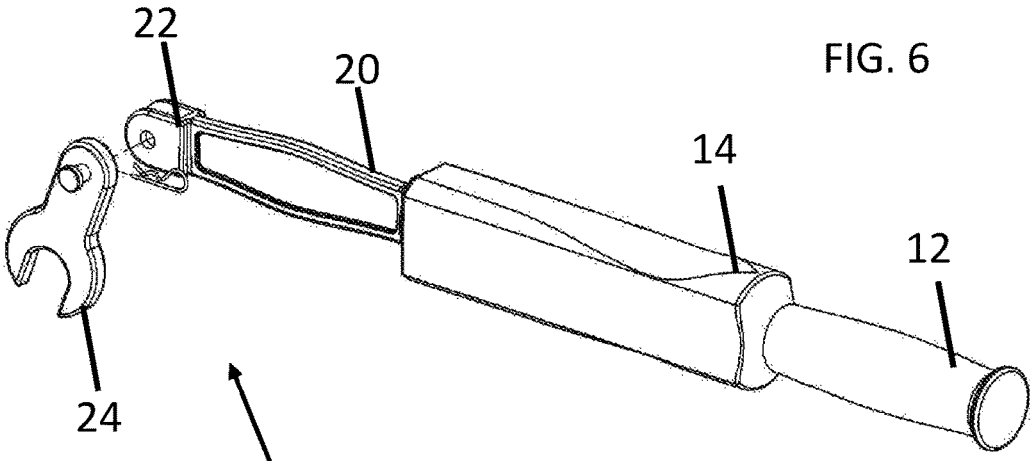
Figure 7:
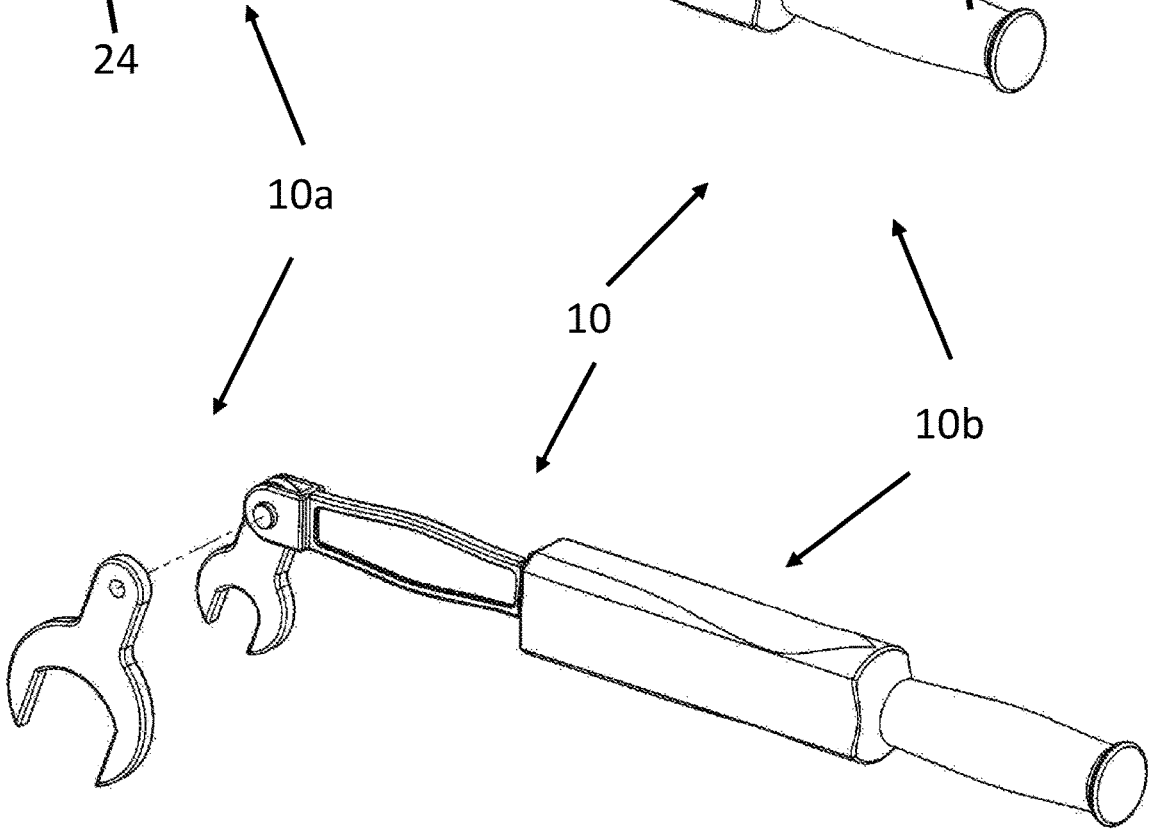

FIG. 3 shows a dissembled view of exemplary wrenches 10, such as shown in FIGS. 1 and 2. The handle 10*b* may include a grip 12 and a slide hammer 14. The head 10*a* may include an interior and/or exterior guide 16 and an impact plate/stopper, or impact portion, 18, of a force translation portion 20 that also includes a tool attachment portion 22. The guide 16 and slide hammer 14 may include one or more corresponding holes to allow the slide hammer 14 and guide 16 to be secured in place in one or more positions using a fastener 15. The fastener 15 may also be configured to allow a physical connection between the slide hammer 14 and guide 16 during operation. In other embodiments, the guide 16 and slide hammer 14 may not be physically connected during operation, but the guide 16 perform the guide function by physically limiting some movements of the slide hammer 14 without a physical connection.

One or more tools 24 may be attached to the tool attachment portion 22 to allow for rotation of the tool 24 in a plane generally parallel to a linear axis (dashed line) of the force translation portion 20, but substantially restrict or prevent non-rotational movement of the tool 24. For example, the tool attachment portion 22 may include a bracket 26 including a hole for alignment with a hole in the tool 24 that may be used with a connector, such as an axis pin 28 and cotter pin 30 to secure the tool 24 in the tool attachment portion 22. One of skill in the art will appreciate that a wide range of connectors may be used to attach the tool 24 to the tool attachment portion 22. While the wrench 10 may generally be configured to allow different tools 24 to be interchangeably used in the wrench 10, there may be various embodiments of the wrench 10 in which one or more tools 24 are semi-permanently or permanently attached to the wrench 10.

Tool 24 may include many different sized and shaped wrench heads including ratcheting and non-ratcheting open-end fixed or adjustable (crescent, vice, etc.), flare nut, 6-point box-end, 12-point box-end, spline, conventional socket adapter, pass-thru socket, etc.

In various embodiments, the slide hammer 14 and the grip 12 may be combined (the grip is provided on the hammer), integrated (e.g., one piece), or discrete (multiple pieces) as shown in FIG. 3. The grip 12 may be configured to be grabbed from the side and/or from the top. In addition, the grip 12 or slide hammer 14 may serve as an impact point, if the application allows for the grip 12 to be impacted, e.g., struck, with a separate hammer or other impact mechanism or tool.

As mentioned above, the slide hammer 14 and grip 12 may be sized and shaped by the skilled artisan to achieve a desired level of impact. For example, for a given dimension, the slide hammer 14 may include a substantial hollow cavity that receives guide 16 or a substantially solid inner core with a bore shaped to tightly receive the guide 16, or variations thereof.

In addition, the length and shape of the guide 16 and slide hammer 14 will also affect the impact that may be delivered. In various embodiments, the guide 16 may be fully contained in the slide hammer 14 at the impact position. In other embodiments, the guide 16 may extend into the grip 12. In still other embodiments, the guide 16 may extend through the slide hammer 14 and grip 12. In other embodiments, the guide may be around at least a portion of the exterior of the slide hammer 14 and may provide another grip for holding the wrench 10.

FIGS. 2, 4, 6, and 7 show the wrench 10 in the impact position in which the slide hammer 14 is in contact with the impact plate/stopper 18 of the force translation portion 20. FIGS. 1 and 5 show the wrench 10 in an extended, or fully loaded, position.

In operation, the user attaches one or more desired tool 24 to the head end 10*a* of the wrench 10. The tool 24 is engaged with a rotatable fitting that is to be loosened or tightened at angle to the linear axis of the wrench 10 (shown as a dashed line in FIGS. 1 and 2). When loosening a traditional fitting the angle will generally be negative relative to the axis and positive when tightening the fitting and generally less than +/−90 degrees relative to the axis of the wrench 10.

The slide hammer 14 is drawn away from the impact position and toward the fully loaded position via the grip 12. The slide hammer 14 is then aggressively moved along guide 16 to impact the impact plate 18 of the force translation portion 20 at the impact position and generate of a force via a hammering effect. The force of the impact is translated through the force translation portion 20 to the tool 24. The translation of the force along the wrench 10 will apply a rotational force to the tool 24 since it is attached at an angle. The impact process is repeated until fastener is "broken lose", so it may be rotated with rotating force tool, or tightened to an extent desired recognizing that it may require the wrench 10 to loosen the fitting if tightened in this manner.

The force translation portion 20 may be designed with various shapes as desired by the skilled practitioner. For example, the force translation portion 20 may be shaped to focus force applied to the impact portion on the tool attachment portion 22.

In applications where additional force is required to rotate the fitting, the handle may be configured to receive an impact when the slide hammer 14 is in the impact position that is translated through the slide hammer. For example, various embodiments may be positioned with the slide hammer 14 in the impact position and a hammer or other impact device is used to impact, e.g., strike, the handle 10*b* of the wrench 10, so as to apply an impact force not generated by sliding the slide hammer.

One skilled in the art will appreciate the wrench 10 of the present invention will likely need to be constructed in whole or at least in part with high strength materials, such as steels, that are suitable to accept and survive repetitive impact. As such, the wrench 10 may need to be significantly stronger than traditional wrenches used to apply a direct rotational force.

It is to be understood that the above description is intended to be illustrative, and not restrictive. Many other embodiments will be apparent to those skilled in the art, upon reviewing the above description. The scope of the invention should, therefore, be determined with reference to any appended claims, along with the full scope of equivalents to which such claims are entitled.

Some implementations are described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" are intended to include one or more items, and may be used interchangeably with "one or more", "at least one", etc., unless specified noted. Furthermore, as used herein, the term "set" is intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

The presence or absence of a summary, abstract, or claims in this application should in no way be considered as limiting on the scope of any inventions disclosed herein.

What is claimed is:

1. An impact wrench comprising:
a handle including a slide hammer;
a head including:
a tool rotatable in a plane, and
a force translation portion,
the force translation portion positioned to translate substantially linear force applied to the force translation portion via the hammer to rotate the tool in the plane; and
a guide extending from the force translation portion,
the hammer translatable along the guide between an impact position contacting the force translation portion and an extended position not contacting the force translation portion, and wherein
the handle is configured to receive an impact from a striking device.

2. The wrench of claim 1, where
the tool is one of open-end fixed, open-end adjustable, flare nut, 6-point box-end, 12-point box-end, spline, conventional socket adapter, and pass-thru socket wrenches.

3. The wrench of claim 1, where
the tool is one of a plurality of interchangeable tools.

4. The wrench of claim 1, where
the handle include a grip.

5. The wrench of claim 1, where
the tool is ratchetable.

6. The wrench of claim 1, where
the guide being at least one of integrated with and separately attachable to the force translation portion.

7. The wrench of claim 1, where
the guide being included in the handle and connected to the force translation portion.

8. The wrench of claim 1, where
the slide hammer is movable relative to the force translation portion and guide.

9. The wrench of claim 1, where
the slide hammer is movable in the plane of rotation of the tool.

10. The wrench of claim 1, where
the force translation portion is symmetric around the wrench.

11. The wrench of claim 1, where
the tool is connected to the force translation portion perpendicular to the movement of the slide hammer.

12. An impact wrench comprising:
a handle including a slide hammer and grip,
the slide hammer moveable in a plane;
a head including:
a tool attachment portion to retain at least one wrench head rotatable in the plane, and
a force translation portion having an impact portion,
the force translation portion positioned to translate force applied by the slide hammer to the impact portion to the tool attachment portion; and
a guide extending from the force translation portion,
the hammer movable along the guide between an impact position contacting the impact portion and at least one extended position not contacting the impact portion, and wherein
the handle is configured to receive an impact from a striking device.

13. The impact wrench of claim 12, where
the wrench head is at least one of open-end fixed, open-end adjustable, flare nut, 6-point box-end, 12-point box-end, spline, conventional socket adapter, and pass-thru socket wrenches.

14. The impact wrench of claim 12, where
the wrench head is detachable from the tool attachment portion.

15. The impact wrench of claim 12, where
a plurality of wrench heads are connected to the tool attachment portion.

16. A method of turning a fitting comprising:
engaging a fitting rotatable in a plane with a tool attached to a force translation portion of an impact wrench;
sliding a slide hammer included in a handle portion of the impact wrench to impact the force translation portion in an impact position and translate a force through the force translation portion to rotate in the plane the fitting engaged by the tool; and
impacting the handle with a striking device to translate additional force through the force translation portion to rotate in the place the fitting engaged by the tool.

17. The method of claim 16, where
the slide hammer is movable relative to the force translation portion along a guide.

18. The method of claim 16, where impacting includes
striking the slide hammer when the slide hammer is in the impact position.

19. The method of claim 16, where
the tool is one of open-end fixed, open-end adjustable, flare nut, 6-point box-end, 12-point box-end, spline, conventional socket adapter, and pass-thru socket wrenches.

20. The method of claim 16, where
the tool converts and imparts at least a portion of the force to the fitting as a rotational force.

* * * * *